US007793451B2

(12) United States Patent
Schaiewitz

(10) Patent No.: US 7,793,451 B2
(45) Date of Patent: Sep. 14, 2010

(54) COLLAPSIBLE SELF-EXPANDING FRAMES AND DISPLAYS AND METHODS FOR USING

(76) Inventor: Daniel Schaiewitz, 87 Slocum Ave., Bronxville, NY (US) 10708

( * ) Notice: Subject to any disclaimer, the term of this patent is extended or adjusted under 35 U.S.C. 154(b) by 511 days.

(21) Appl. No.: 11/766,593

(22) Filed: Jun. 21, 2007

(65) Prior Publication Data

US 2008/0313945 A1 Dec. 25, 2008

(51) Int. Cl.
*A47G 1/06* (2006.01)

(52) U.S. Cl. ..... 40/787; 40/782; 40/788; 40/789; 40/776; 40/765

(58) Field of Classification Search ..... 40/781, 40/782, 787, 788, 789, 786, 539, 775, 776, 40/765, 774, 720
See application file for complete search history.

(56) References Cited

U.S. PATENT DOCUMENTS

| | | | | | |
|---|---|---|---|---|---|
| 822,841 | A | | 6/1906 | Hill | |
| 849,111 | A | * | 4/1907 | Fairchild | 40/786 |
| 875,691 | A | | 7/1908 | Cheney | |
| 899,393 | A | | 9/1908 | Fratcher | |
| 2,144,594 | A | | 1/1939 | Katz | |
| 2,293,900 | A | | 8/1942 | Horr | |
| 2,312,644 | A | | 3/1943 | Horr | |
| 2,332,642 | A | * | 10/1943 | Johnson | 40/787 |
| 2,373,074 | A | | 4/1945 | Ziemmerman | |
| RE22,683 | E | * | 10/1945 | Piper | 40/786 |
| 2,641,858 | A | * | 6/1953 | Burr | 40/766 |
| 2,731,748 | A | | 1/1956 | Polay | |
| 2,773,324 | A | | 12/1956 | Drueck, Jr. | |
| 2,851,804 | A | * | 9/1958 | Roach | 40/539 |
| 2,892,276 | A | | 6/1959 | Nelson | |
| 3,010,246 | A | | 11/1961 | England | |
| 3,234,682 | A | | 2/1966 | Frankl | |
| 3,267,597 | A | | 8/1966 | Jannes | |
| 3,394,479 | A | * | 7/1968 | Siegler | 40/786 |
| 3,664,049 | A | | 5/1972 | Smith | |
| 3,775,884 | A | | 12/1973 | Smith | |
| 4,286,400 | A | | 9/1981 | MacPherson | |
| 4,619,426 | A | | 10/1986 | Drueck, Jr. | |
| 4,738,041 | A | * | 4/1988 | Drueck, Jr. | 40/788 |
| 4,771,557 | A | * | 9/1988 | Bowman | 40/771 |
| 4,780,975 | A | | 11/1988 | Friedman | |
| 4,794,024 | A | | 12/1988 | Crowell et al. | |
| 4,854,060 | A | * | 8/1989 | Corbo et al. | 40/720 |

(Continued)

*Primary Examiner*—Gary C Hoge
(74) *Attorney, Agent, or Firm*—Schmeiser, Olsen & Watts, LLP

(57) ABSTRACT

Display frames and methods. The display frame includes an outer frame having a substantially hollow interior. The outer frame includes a front face having an opening, a back panel spaced from the front face, and side members hingedly connecting the front face and to the back panel. An embodiment includes at least one elastic member disposed inside the hollow interior and flexibly connected to the outer frame. An embodiment includes an inner frame having a second opening, where the inner frame is disposed between and spaced from the front face and the back panel. The method includes providing a collapsible, self-expanding display frame. An embodiment includes selecting a design for the outer frame and printing the design onto the outer frame. An embodiment includes selecting a design, providing a frame cover, printing the design onto the frame cover, and after the printing, applying the frame cover to the display frame.

30 Claims, 15 Drawing Sheets

U.S. PATENT DOCUMENTS 5,096,751 A 3/1992 Duchek
5,383,293 A 1/1995 Royal
5,467,547 A 11/1995 Fortner
5,513,455 A 5/1996 Walker
5,592,768 A 1/1997 Testa
5,678,339 A * 10/1997 Marventano ..... 40/789
5,936,862 A 8/1999 Wong
5,937,553 A * 8/1999 Maran ..... 40/124.08
6,427,371 B2 8/2002 Olson et al.
6,510,637 B2 1/2003 DeLozada et al.
7,159,351 B2 1/2007 Sparkowski
2002/0129530 A1 9/2002 Delozada
2006/0010734 A1 1/2006 Boydston

* cited by examiner

COLLAPSIBLE SELF-EXPANDING FRAMES AND DISPLAYS AND METHODS FOR USING

FIELD OF THE INVENTION

The invention generally relates to collapsible, self-expanding display frames.

BACKGROUND OF THE INVENTION

Retail locations such as portrait studios, theme parks, resorts, cruise ships, one-hour photograph concessions, etc. providing photographs to consumers may offer consumers a flat folder for their photographs, rather than a traditional picture frame made of wood, metal, or ceramic, which may be bulky, expensive, and difficult for the consumer to transport or mail due to size, fragility, and weight. A consumer may be given limited options with respect to enhancing or displaying such purchased photographs. There exists a need for a picture frame that is cost-effective, lightweight, and adaptable to enhancement by a consumer.

SUMMARY OF THE INVENTION

The present invention relates to a display frame, comprising:

an outer frame having a substantially hollow interior, said outer frame including a front face having an opening, a back panel spaced from said front face, and side members hingedly connecting said front face to said back panel; and at least one elastic member disposed inside said hollow interior and flexibly connected to said outer frame.

The present invention relates to a display frame, comprising:

an outer frame having a substantially hollow interior, said outer frame comprising a front face having an opening, a back panel spaced from said front face and side members hingedly connecting said front face to said back panel; and an inner frame having a second opening, said inner frame disposed between and spaced from said front face and said back panel.

The present invention relates to a method, comprising:

providing a collapsible, self-expanding display frame comprising an outer frame having a front face having an opening, a back panel spaced from said front face, and side members hingedly connecting said front face to said back panel, and at least one elastic member flexibly connected to at least one attachment point on said outer frame;

selecting a design;

providing a frame cover configured to substantially conform to said front face, said back panel, at least one side member of said side members, or combinations thereof;

printing said design onto said frame cover; and after said printing, applying said frame cover to said display frame.

The present invention relates to a method, comprising:

providing a collapsible, self-expanding display frame comprising an outer frame having a front face having an opening, a back panel spaced from said front face, and side members hingedly connecting said front face to said back panel, and at least one elastic member flexibly connected to at least one attachment point on said display frame;

selecting a design for said outer frame;

inserting said outer frame into a printing device; and printing said design onto said outer frame.

BRIEF DESCRIPTION OF THE DRAWINGS

The features of the invention are set forth in the appended claims. The invention itself, however, will be best understood by reference to the following detailed description of illustrative embodiments when read in conjunction with the accompanying drawings.

DETAILED DESCRIPTION OF THE INVENTION

Figure 1:
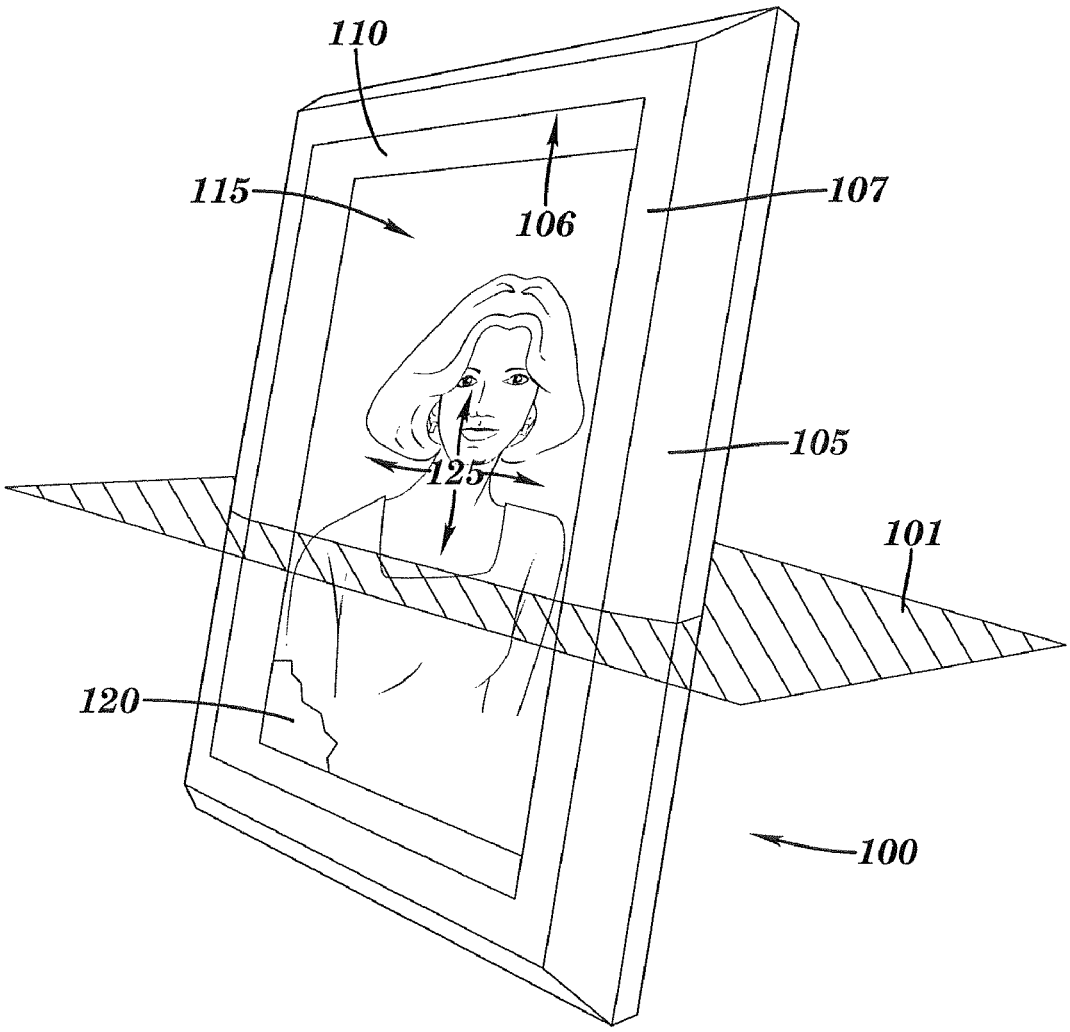
FIG. 1 is a perspective illustration of a display frame, in accordance with embodiments of the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as examples of embodiments. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

FIG. 1 is a perspective illustration of a display frame 100 in an embodiment of the present invention. The display frame or enclosure 100 may comprise an outer frame 105, comprising a back panel or support 120 and a front face or support 107. The outer frame may be substantially cubic or box-like in shape. The display frame 100 may further comprise an inner frame 110. The inner frame 110 may be disposed between and spaced from the back panel 120 and the front face 107. The display frame 100 may have an opening 115 passing through the front face 107 and the inner frame 110, forming a substantially hollow interior 125 of the display frame 100. The front face 107 may have an interior edge 106. The front face 107 and back panel 120 may be substantially planar and parallel to each other. The inner frame 110 may be substantially planar, disposed between and substantially parallel to the back panel 120 and the front face 107.

Figure 2:
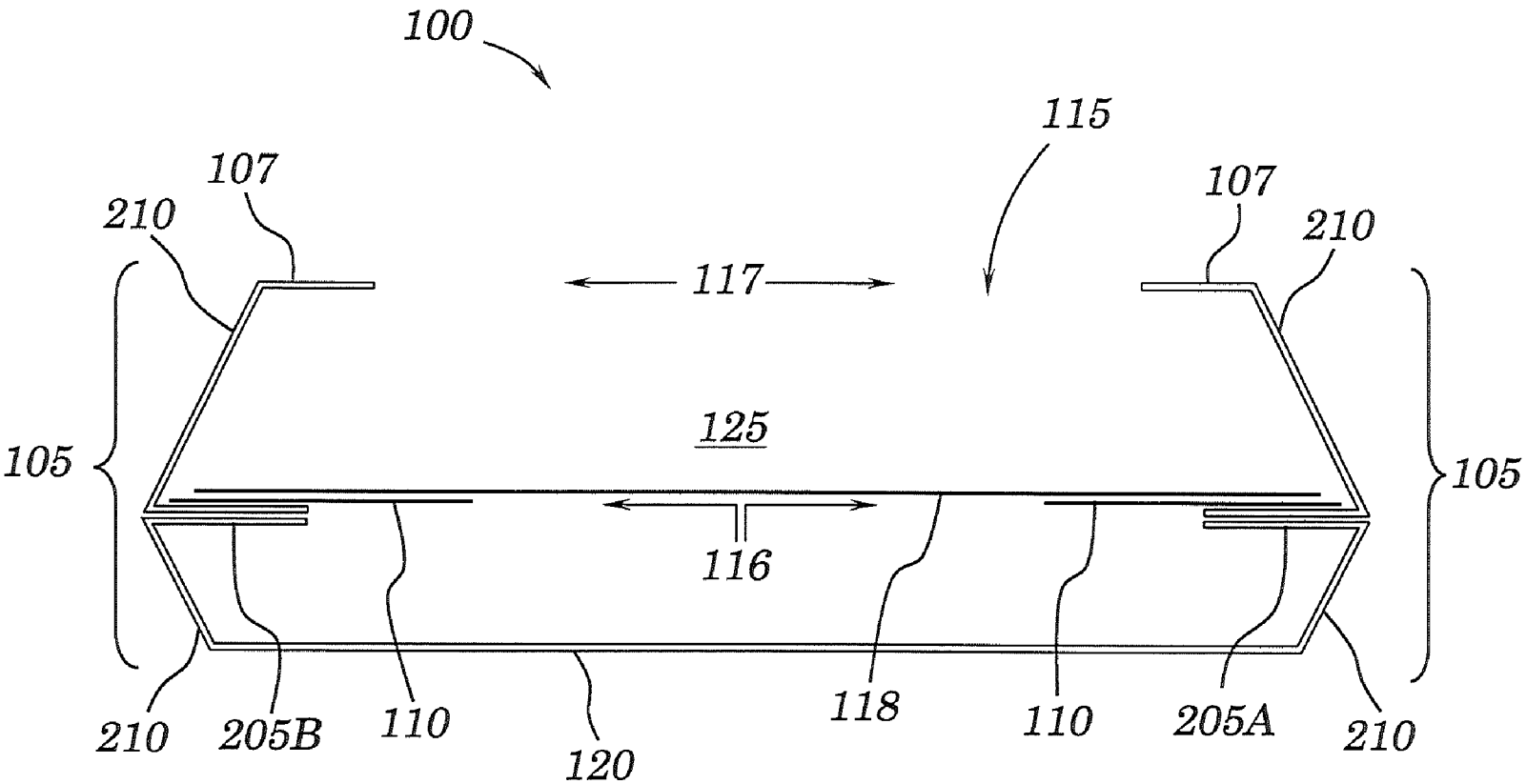
FIG. 2 is an illustration of a cross section of the display frame of FIG. 1, in accordance with embodiments of the present invention.

FIG. 2 is an illustration of a cross section of the display frame 100 of FIG. 1 through plane 101. The inner frame 110 may be disposed between the back panel 120 and the front face 107. The display frame 100 may comprise an opening 115, wherein the display frame opening 115 may comprise an inner frame opening 116 and a front face opening 117 integrally joined to form the continuous display frame opening 115 through which a displayed item may be viewed. The display frame may comprise a substantially hollow interior 125. The inner frame may be supported by inwardly protruding flanges 205A and 205B of the outer frame 105, such that the inner frame 110 may be disposed at finite distances from each of the back panel 120 and the front face 107. The inner frame 110 may be supported by the inwardly protruding flanges 205A and 205B in a position and/or orientation which is substantially parallel to the front face 107 and the back panel 120. The frame 100 may comprise side members or supports 210, where the side members 210 may be hingedly connected to the front face 107 and the back panel 120 in order to swivel, pivot, or articulate. The side members 210 may have a beveled, square, inclined, angled, or irregular configuration. The frame 100 may comprise at least one side member 210, such as one, two, three, four, or more side members 210.

In one embodiment, the display frame 100 may further comprise a substantially transparent sheet 118 disposed between the inner frame 110 and the front face 107, where the transparent sheet 118 may be directly adjacent to the inner frame 110 such that the transparent sheet 118 substantially covers the inner frame 110. The transparent sheet 118 may be comprised of plastic or similar material which is substantially transparent. The sheet may be configured to be imprinted with words or other graphics, which may result in a desirable visual effect where the words or graphics may be raised above the plane of an item displayed in the display frame 100. The sheet 118 may provide protection from dust and damage to a displayed item.

Figure 3:
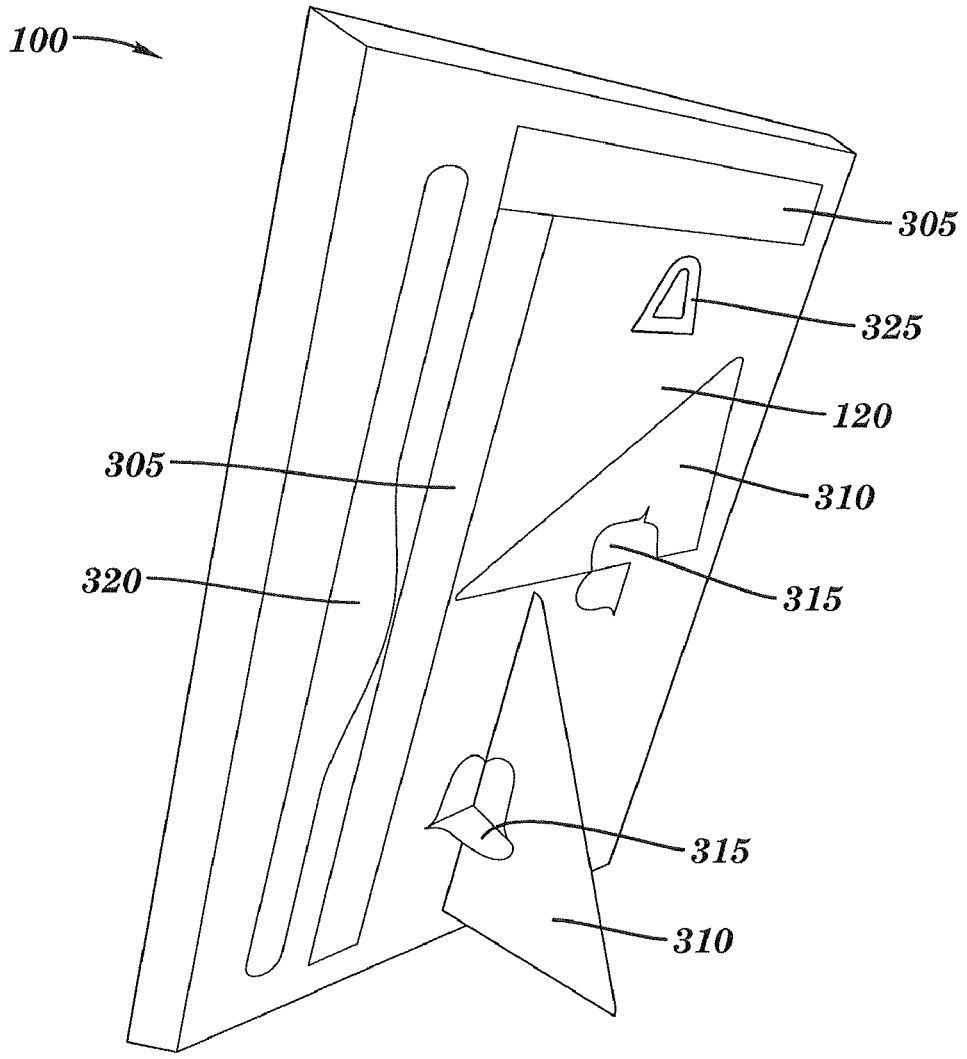
FIG. 3 is a perspective illustration of a frame of the present invention showing a backside view of the frame, in accordance with embodiments of the present invention.

FIG. 3 is a perspective illustration of a frame 100 of the present invention showing a backside view of the frame 100, wherein back panel 120 may comprise at least one easel back stand 310 with at least one easel support brace 315. The easel back stand 310 and easel support brace 315 may provide support for the frame 100 in a plurality of positions, for example when the frame 100 is resting on a substantially horizontal surface. For example, the easel back stand 310 and support brace 315 may support the frame 100 in a substantially vertical position, substantially perpendicular to a horizontal surface on which the frame 100 may be resting.

The back panel 120 of frame 100 may comprise at least one hanging device 325, where the hanging device may be configured to facilitate hanging the frame 100 on a substantially vertical surface, such as a wall.

The back panel 120 of frame 100 may comprise a mounting device 305 for mounting the frame 100, such as magnets, which may be adhered to the back panel 120 and may allow placement of the frame 100 on metal surfaces such as a refrigerator door, for example. Other means for mounting may comprise hook and loop fasteners such as VELCRO, adhesive tape, adhesive gels, tacks, hooks, and combinations of these.

Figure 4:
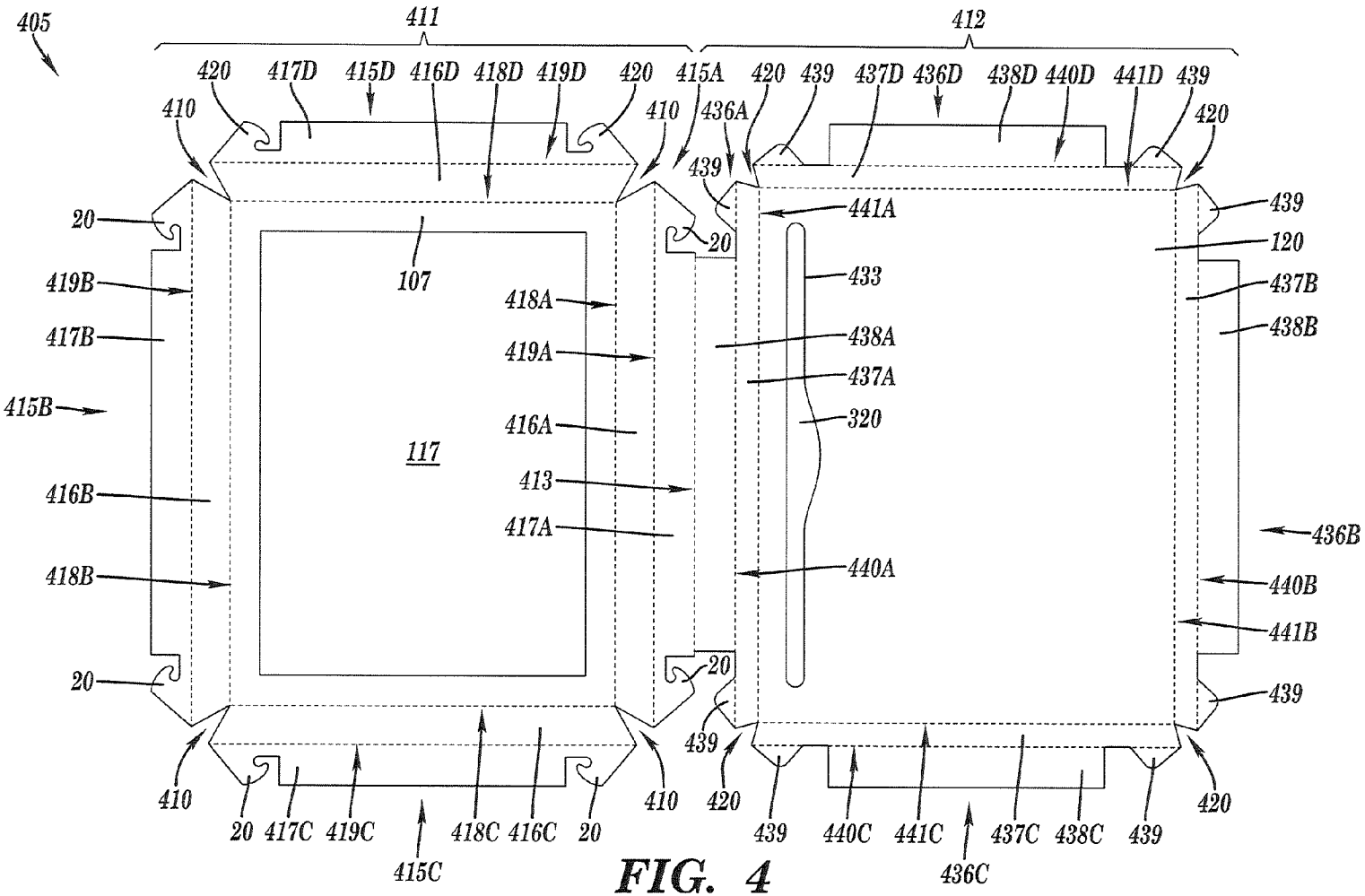
FIG. 4 is an illustration of an example of a die-cut blank, in accordance with embodiments of the present invention.

FIG. 4 is an illustration of an example of a die-cut blank 405 in an embodiment of the present invention, where the die-cut blank 405 comprises a single, continuous piece of material and may be assembled to form the outer frame 105 of FIG. 1. The die-cut blank 405 may be any suitably rigid material that can be die-cut and hold its shape while assembled as the outer frame 105. For example, the die-cut blank 405 and outer frame 105 may be comprised of paper, plastic, cardboard, combinations thereof, and the like. Materials such as these may provide to the display frame 100 the advantages of light weight, low manufacturing and mailing costs, and superior presentation. The die-cut blank may be configured such that all scored lines are made on the same side of die-cut blank 405, resulting in die-cutting only one side of the blank during manufacture.

The die-cut blank 405 may comprise two substantially rectangular portions 411 and 412. Portions 411 and 412 may be hingedly connected to each other, such as along a common scored line 413. Portion 411 may comprise front face opening 117, defined by the periphery of face panel 107. Integrally and hingedly attached to each side of face panel 107 may be side panels 415A, 415B, 415C, and 415D. Each side panel 415A, 415B, 415C, and 415D may comprise subpanels 416A, 416B, 416C, and 416D, respectively as shown, hingedly connected along creased scorelines 419A, 419B, 419C, and 419D, respectively, to subpanels 417A, 417B, 417C, and 417D, respectively, as shown. Subpanels 416A, 416B, 416C, and 416D may be hingedly attached to face panel 107 along creased scorelines 418A, 418B, 418C, and 418D, respectively. Panels 415A, 415B, 415C, and 415D may have attachment points 20 at each end of subpanels 415A, 415B, 415C, and 415D.

Portion 412 may comprise back panel 120. Side panels 436A, 436B, 436C, and 436D may be hingedly attached to each side of back panel 120 along creased scorelines 441A, 441B, 441C, and 441D, respectively. Side panels 436A, 436B, 436C, and 436D may comprise subpanels 437A, 437B, 437C, and 437D, respectively as shown, hingedly connected along crease scorelines 440A, 440B, 440C, and 440D, respectively, to subpanels 438A, 438B, 438C, and 438D respectively as shown. Side panels 436A, 436B, 436C, and 436D may have projections 439 on each end of side panels 436A, 436B, 436C, and 436D.

Portion 411 may comprise angular cut out sections 410 separating the ends of each panel 415 from each adjacent panel 415. Similarly, portion 412 may comprise angular cut out sections 420 separating the ends of each panel 436 from each adjacent panel 436. The angle of sections 410 and 420 may be configured to allow for proper assembly of the final outer frame 100. For example, the degree of the angle may determine the final frame configuration.

The die-cut blank 405 may be assembled into the outer frame 105 by folding along scored lines and fastening together specific areas of the die-cut blank 405. Areas may be fastened together using liquid adhesives, tape, metal fasteners, hot melt adhesives, hook and loop fasteners such as VELCRO, combinations of these, and the like. The die-cut blank 405 may be configured to direct the interconnection of interlocking segments on frame panels, where the frame areas may be self-fastening, where adhesives and metals fasteners as described above may not be required. In the embodiment described below, a liquid adhesive is described for illustrative purposes, and is not meant to limit the means by which areas of the die-cut blank 405 may be adhered or connected together.

In an embodiment of the present invention, adhesive may be applied to the subpanels 438A to 438D and all eight projections 439 on each of subpanels 438A-438D. Subpanel 438A and adjacent projections 439 may be folded inwardly along scored line 440A, while subpanel 417A and adjacent projections 20 may be folded inwardly along scored line 419A. Subpanel 438A and subpanel 417A may then be folded flush against each other by folding along creased scoreline 413 such that the adhesive on subpanel 438A and projections 439 substantially adheres subpanel 438A and projections 439 to subpanel 417A, resulting in scorelines 419A and 440A lying adjacent to each other.

Subpanels 417B, 417C, and 417D along with respective included projections 20 may then be folded inwardly along scored lines 419B, 419C, and 419D, respectively.

Subpanels 438B, 438C, and 438D, and adjacent respective projections 439 may be folded inwardly along scored lines 440B, 440C, and 440D, respectively. Portions 411 and 412 may then be folded inwardly toward each other along scorelines 419A and 440A until substantially flush contact is made between subpanels 417B, 417C, 417D with adjacent respective projections 20, and subpanels 438B, 438C, 438D with adjacent respective projections 439, respectively, where respective subpanels on portion 411 substantially cover and adhere to respective subpanels on portion 412.

Cut line 433 of portion 412 may define cut out slot 320 of FIG. 3. Cut out slot 320 may be configured to allow insertion of a photograph, picture, drawing, design, or the like through slot 320 and into the frame 100 after assembly, for example, the slot 320 may be substantially oblong in shape.

Figure 5:
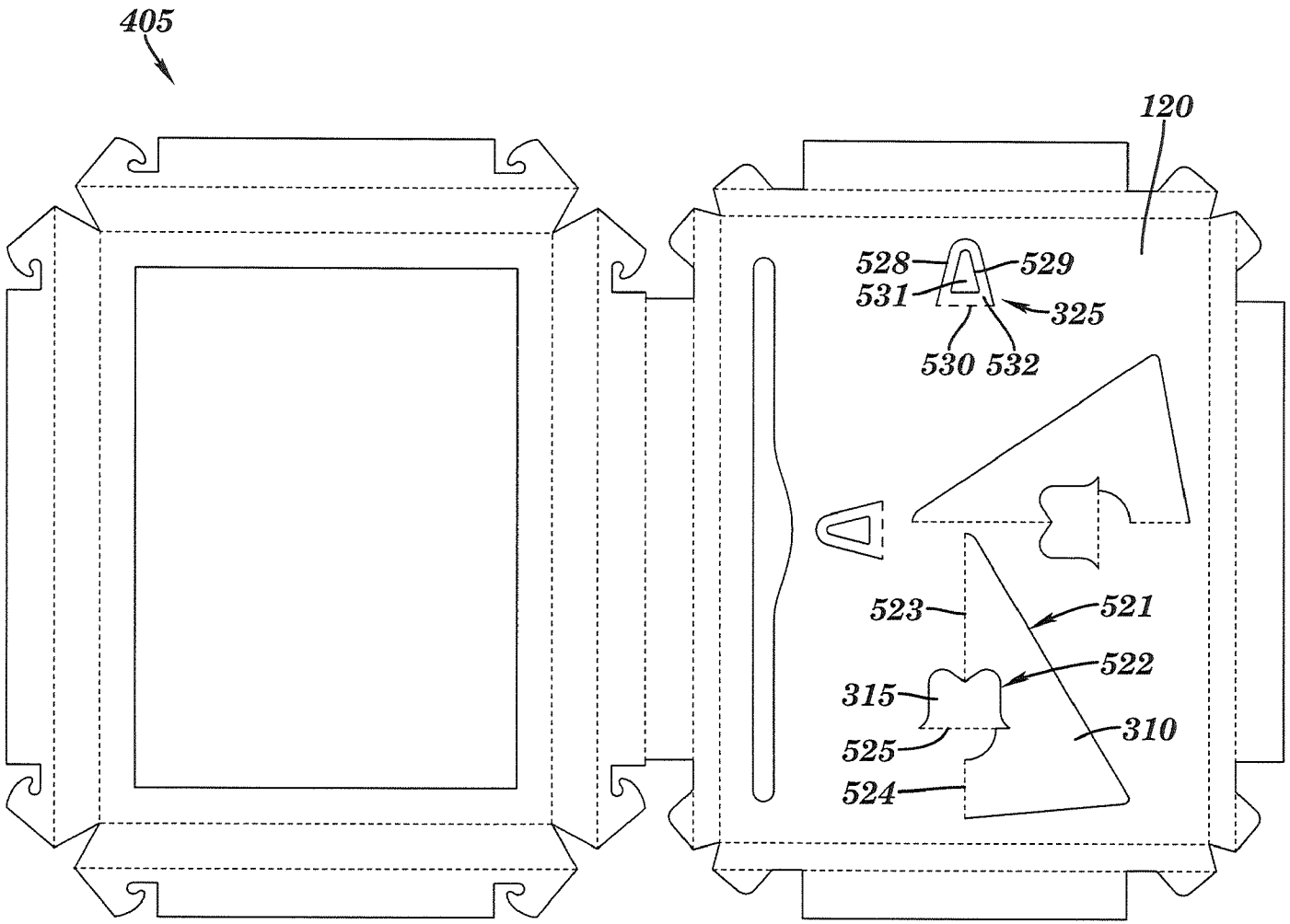
FIG. 5 is an illustration of an embodiment of the die-cut blank of FIG. 4, in accordance with embodiments of the present invention.

FIG. 5 is an illustration of an embodiment of the die-cut blank 405 of FIG. 4, wherein the back panel 120 may comprise at least one easel back stand 310 with at least one easel support brace 315. Easel back stand 310 and easel support brace 315 may be formed from cut-out lines 521 and 522 and scored lines 523, 524, and 525 when easel back stand 310 and easel support brace 315 are folded outwardly from the plane of FIG. 5 along score lines 523, 524, and 525.

Cut lines 528 and 529 and scored line 530 may form at least one hanging device 325, wherein the hanging device 325 may be configured to facilitate hanging the assembled frame 100 on a substantially vertical surface, such as a wall. Section 532 may be defined by cut line 528 and scored line 530, and may be rotated outwardly along scored line 530 to provide a hanging device 325 after the removal of section 531 to form a hole through which a nail, hook, etc. may be inserted. Section 531 may be removed during manufacture or left in place by small uncut portions or bridges of cut line 529, where a user may remove section 531 prior to use.

Figure 6:
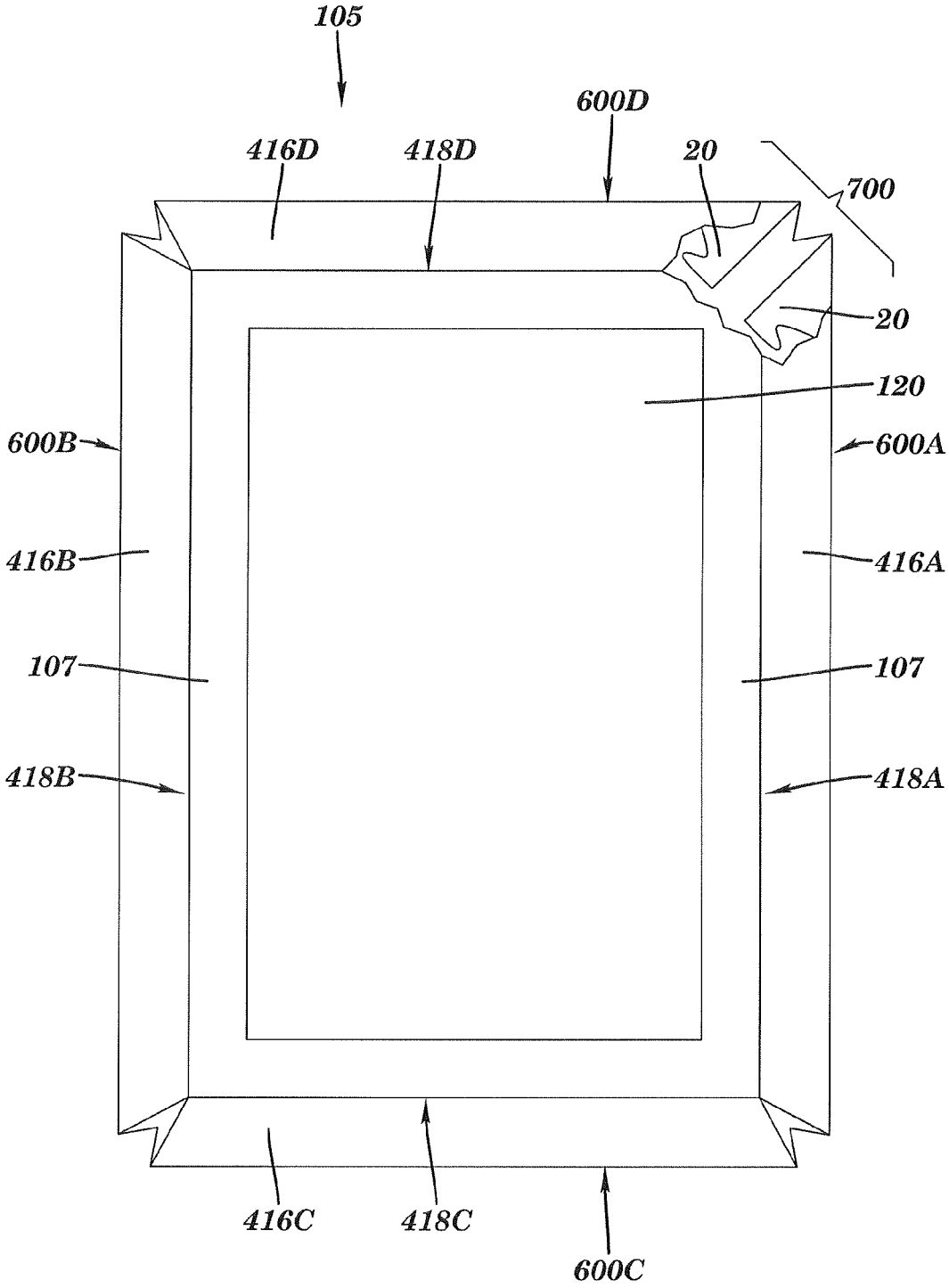
FIG. 6 is an illustration of a substantially collapsed outer frame, in accordance with embodiments of the present invention.

FIG. 6 is an illustration of a substantially collapsed outer frame 105 of the present invention after portion 411 in FIG. 4 has been adhered to portion 412 in FIG. 4 as described above. The creased scorelines 419A and 440A in FIG. 4 may be joined to form side edge 600A in FIG. 6. The creased scorelines 419B and 440B in FIG. 4 may be joined to form side edge 600B in FIG. 6. The creased scorelines 419C and 440C in FIG. 4 may be joined to form side edge 600C in FIG. 6. The creased scorelines 419D and 440D in FIG. 4 may be joined to form side edge 600D in FIG. 6.

Cut-away section 700 in FIG. 6 illustrates one set of attachment points 20 of the outer frame 105. Drawing or forcing adjacent attachment points 20 together may force parallel side edges 600A and 600B in FIG. 6 towards each other, and may force parallel side edges 600C and 600D towards each other, resulting in forcing frame subpanels 416A, 416B, 416C, and 416D to rotate along scored lines 418A, 418B, 418C, and 418D, respectively, with respect to front face 107, and likewise, referring to FIG. 4, forcing frame panels 437A, 437B, 437C, and 437D to rotate along scored lines 441A, 441B, 441C, and 441D, respectively, with respect to back panel 120.

The final resting position of subpanels 416A, 416B, 416C, and 416D may be determined by the cut out angles 410 of outer frame portion 411 (see FIG. 4) as the ends of panels 416A, 416B, 416C, and 416D are forced into angular abutment to rotate inwardly. Referring to FIG. 4, the final resting position of panels 437A, 437B, 437C, and 437D may be determined by the cut out angles 420 of outer frame portion 412 (see FIG. 4) as the ends of panels 437A, 437B, 437C, and 437D are forced into angular abutment and to rotate outwardly.

Figure 7A:
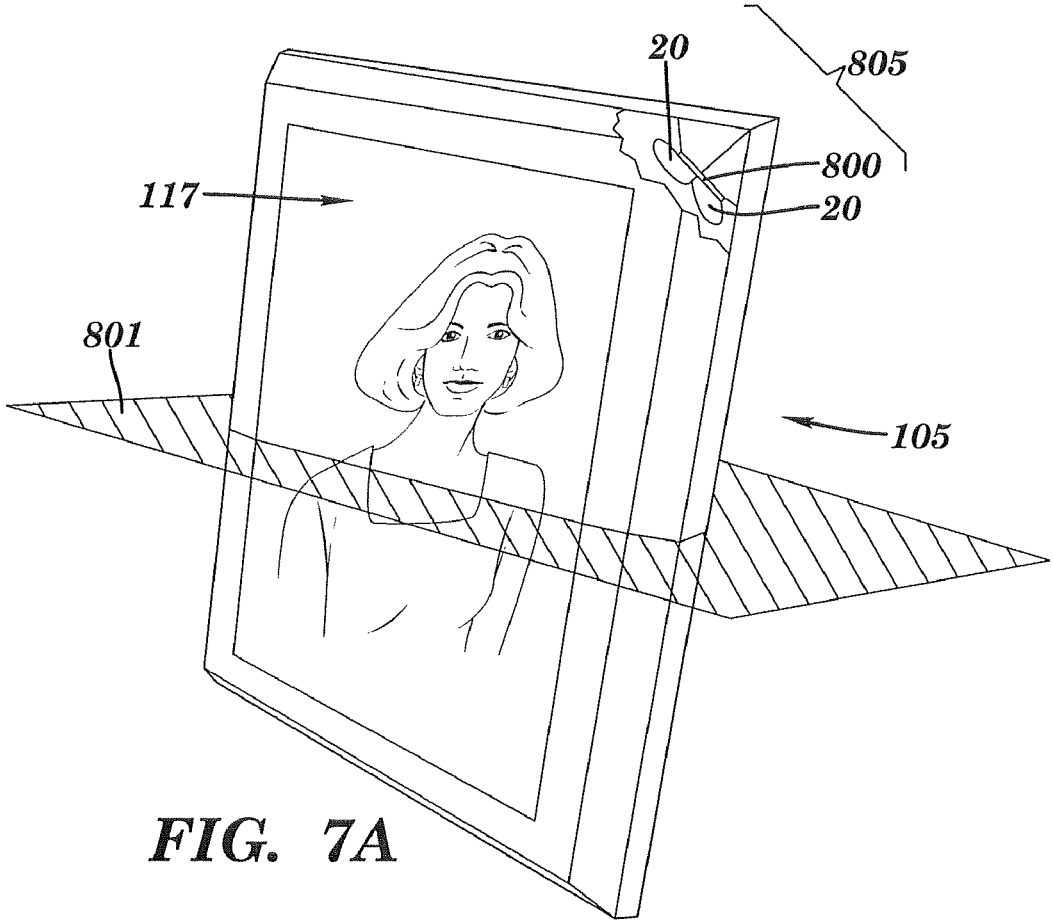
FIG. 7A is an illustration of the outer frame of FIG. 1 with a cut-away section, in accordance with embodiments of the present invention.
Figure 7B:
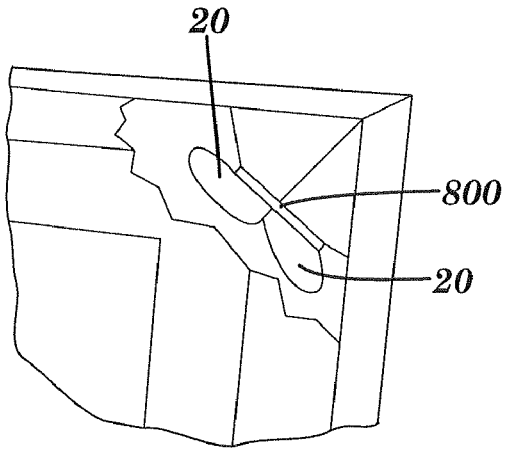
FIG. 7B is an expanded view of the cutaway section of FIG. 7A, in accordance with embodiments of the present invention.

FIG. 7A is an illustration of the outer frame 105 of FIG. 1 with a cut-away section 805 showing attachment points 20 of outer frame 105 where adjacent attachment points 20 may be forced together as described above by at least one elastic member 800. FIG. 7B is an expanded view of the cutaway section 805 of FIG. 7A. The display frame of the present invention may comprise at least one elastic member 800, such as four elastic members, for example. The attachment points 20 of the outer frame 105 may be configured to allow the attachment of the at least one elastic member 800. The attachment of at least one elastic member 800 between adjacent attachment points 20 on each of the four corners of the outer frame 105 may automatically force the outer frame 105 to self-expand from a substantially compressed or flattened configuration, such as illustrated in FIG. 6, to a substantially expanded configuration, such as illustrated in FIG. 7. Tension from the elastic member 800 may reversibly hold the attachment points 20 abutting each other, such that the elastic members 800 may reversibly force the outer frame 105 into an expanded position. Individual elastic member 800 may be attached to each of four adjacent pairs of attachment points 20 in each corner of outer frame 105. In another embodiment, a single long elastic member 800 may be attached to all the attachment points 20 on all four corners of the outer frame 105.

The attachments points 20 may be accessed through the opening 117 in the front face 107. For example, a user may use a small pair of pliers to wrap a rubber band around each adjacent pair of attachment points 20 by reaching the pliers through the opening 117. Examples of elastic members may include rubber bands, elastomer bands, springs, elasticized fabric, combinations of these and the like.

The tension of the elastic members 800 may automatically maintain the three-dimensional configuration of the outer frame 105 in an expanded configuration. When a compressive force is applied, the frame 100 may be reversibly compressed into a substantially compressed or flat configuration, which may result in stretching the elastic members into an elongated state under tension, resulting in the front face 107 and the back panel 120 moving towards each other such that the front face 107 is substantially flush against the inner frame 110 (see FIG. 1) and the inner frame 110 is substantially flush against the back panel 120. The display frame 100 may be stored in a substantially flat or substantially compressed configuration to take up minimal space. Removal of the compressive force may allow the frame 100 to self-expand to its original expanded configuration, due to the retraction of the elastic members 800 flexibly connected to attachment points on the outer frame 105. Storage space may be limited at retail locations such as portrait studios, one-hour photo labs, photo kiosks, souvenir shops, etc., and therefore the reversibly collapsible, self-expanding feature of the present invention may be desirable to reduce storage needs. The collapsible frame 100 of the present invention may be placed in a mailing or storage envelope to apply a constant compressive force and maintain its flat and compressed configuration.

Figure 8A:
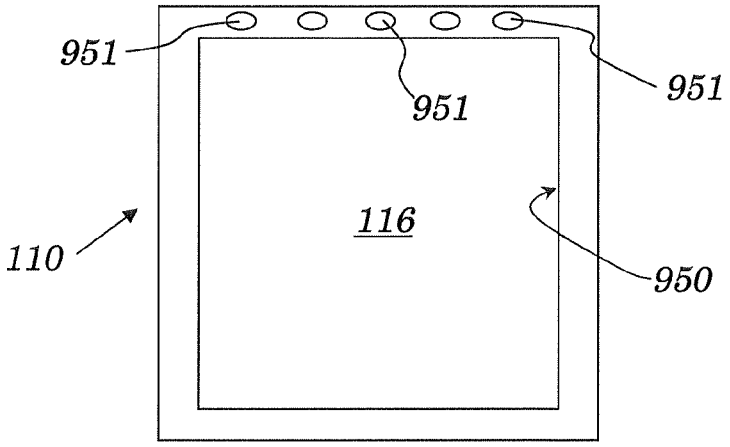
FIG. 8A is an illustration of a substantially rectangular inner frame having an opening comprising an interior edge, in accordance with embodiments of the present invention.

FIG. 8A is an illustration of a substantially rectangular inner frame 110 having an opening 116 comprising an interior edge 950, where the opening 116 may be substantially rectangular. The inner frame 110 may be disposed between a front face 107 and a back panel 120 of an outer frame 105, such as in FIG. 1 and FIG. 2, for example. The inner frame 110 may create an additional dimensional effect for an item displayed in the display frame 100 of FIG. 1 by accentuating the depth of the frame 100. The inner frame 110 may be comprised of paper or similarly flexible material that may be bent and manipulated without permanent creasing.

The inner frame 110 may comprise cut-out sections 951 where material may be cut away to leave a cut out section 951 or opening in the inner frame 110. The cut-out section may be configured in a desirable shape (such as circles, stars, letters, words, ships, animals, etc.) which may enhance the appearance of a displayed item in the frame 100. For examples, alphabetical letters may be cut out of the inner frame 110 for displaying a child's picture, or shapes of ships may be cut out to produce a nautical theme for a displayed item. Likewise, the outer frame 105 or components thereof, such as the front face 107 as in FIG. 1 and side members 210 as in FIG. 2, may be cut with additional cut-out sections as described above for the inner frame 110.

Figure 8B:
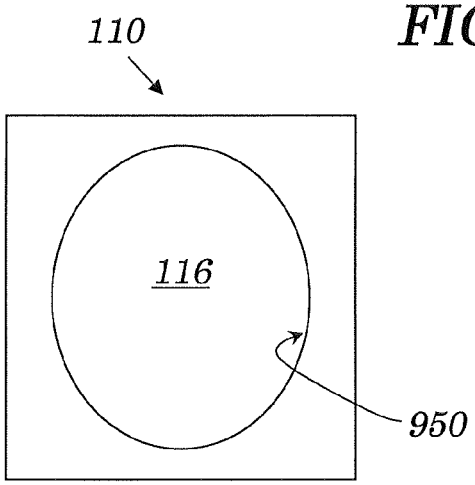
FIG. 8B is an illustrated example of an interior edge of the inner frame configured such that the opening may conform to a shape of an oval as in FIG. 8B, in accordance with embodiments of the present invention.
Figure 8C:
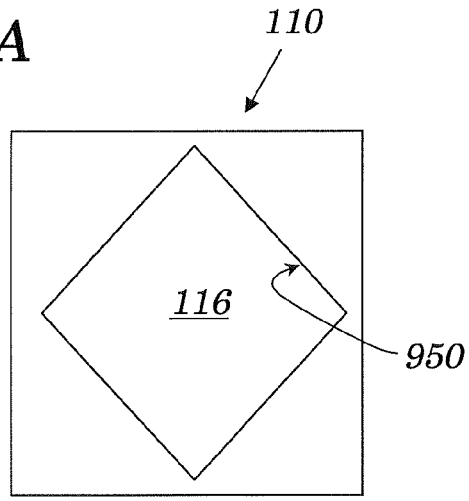
FIG. 8C is an illustrated example of an interior edge of the inner frame configured such that the opening may conform to a shape of a diamond, in accordance with embodiments of the present invention.
Figure 8D:
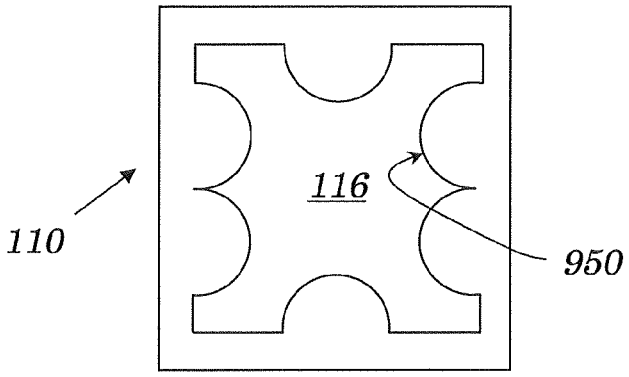
FIG. 8D is an illustrated example of an interior edge of the inner frame die-cut into shapes that may protrude into the opening of the inner frame, in accordance with embodiments of the present invention.

An interior edge 950 of the inner frame 110 may be configured such that the opening 116 may comprise various shapes. Such shapes may provide decorative appeal to the frame of the present invention. FIGS. 8B, 8C, and 8D are illustrated examples of how an interior edge 950 of the inner frame 110 may be configured such that the opening 116 may conform to a shape other than a rectangle, such as an oval as in FIG. 8B, a diamond as in FIG. 8C, and the like. Interior edge 950 may be die cut to produce a repeating pattern along the edge 950 or into shapes that protrude into the opening 116 of the inner frame 110, such as waves as illustrated in FIG. 8D. For example, an inner frame 110 may be decorated with an aquatic theme where the interior edge 950 is configured to conform to shapes of fish that protrude into the opening 116. Those skilled in the art will recognize that there exist numerous equivalents to edge designs for the inner frame 900 that are included within the scope of the present invention. Similarly, an interior edge 106 of front face 107 of outer frame 105, such as in FIG. 1, may be configured such that an opening 117 of the outer frame 105 may be shaped as described above for the inner frame 110.

Figure 9:
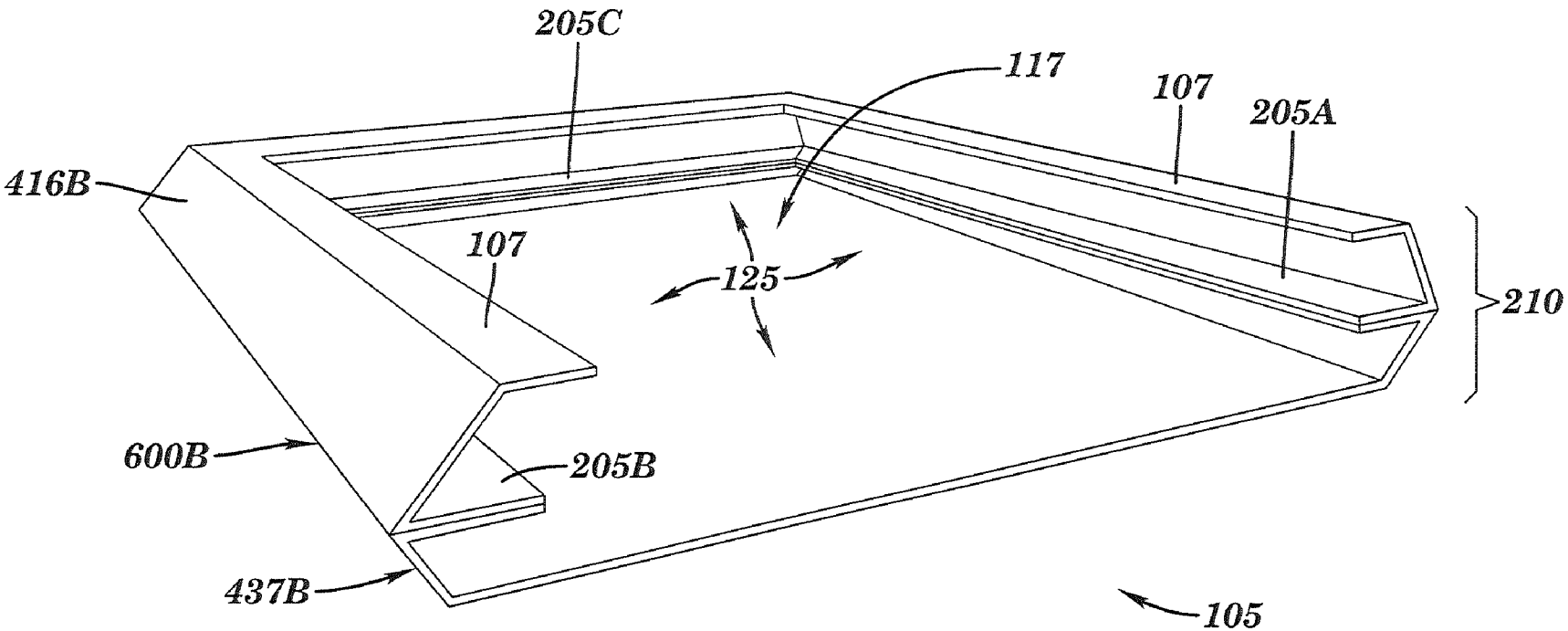
FIG. 9 is an illustration of a perspective cut-away view of an outer frame cut through plane 801 of FIG. 7A, in accordance with embodiments of the present invention.

FIG. 9 is an illustration of a perspective cut-away view of an outer frame 105 cut through plane 801 of FIG. 7A. Flanges 205A, 205B, and 205C, may be formed from the folding of subpanels of the die-cut blank 405 in FIG. 4 as described above, and may protrude into the substantially hollow interior 125 of the outer frame 105. For example, subpanel 438B of FIG. 4 may be adhered to subpanel 417B of FIG. 4 during assembly of the frame 105, as described above, to form a flange 205B. Similarly, flange 205A may be formed from the adhering of subpanel 438A against subpanel 417A, and flange 205C may be formed from the adhering of subpanel 438C against subpanel 417C. Likewise, an analogous flange may be formed from the adhering of subpanel 438D against subpanel 417D in a manner similar that described above The outer frame 105 may comprise at least one flange, for example the outer frame 105 may comprise four flanges, as described above. The flanges may provide support for an inner frame 110 (as in FIG. 1 and FIG. 2), where the inner frame 110 may be bent and manipulated through the opening 117 in the front face 107 such that the inner frame 110 rests on the inwardly protruding flanges, such as those shown in, FIG. 2 and FIG. 9. The flanges may thus support the inner frame 110 in a position and orientation disposed at a distance from the front face 107 and back panel 120, where the inner frame 110 may be substantially parallel to the back panel 120 and substantially parallel to the front face 107.

The elastic members 800 may be obscured from view of the user, due to their location inside the substantially hollow interior of the expanded display frame 100 and by being substantially covered by the inner frame 110. This feature increases the presentation value of the display frame 100 of the present invention, whereas elastic members which are clearly visible may be unsightly and undesirable to a user.

Figure 10:
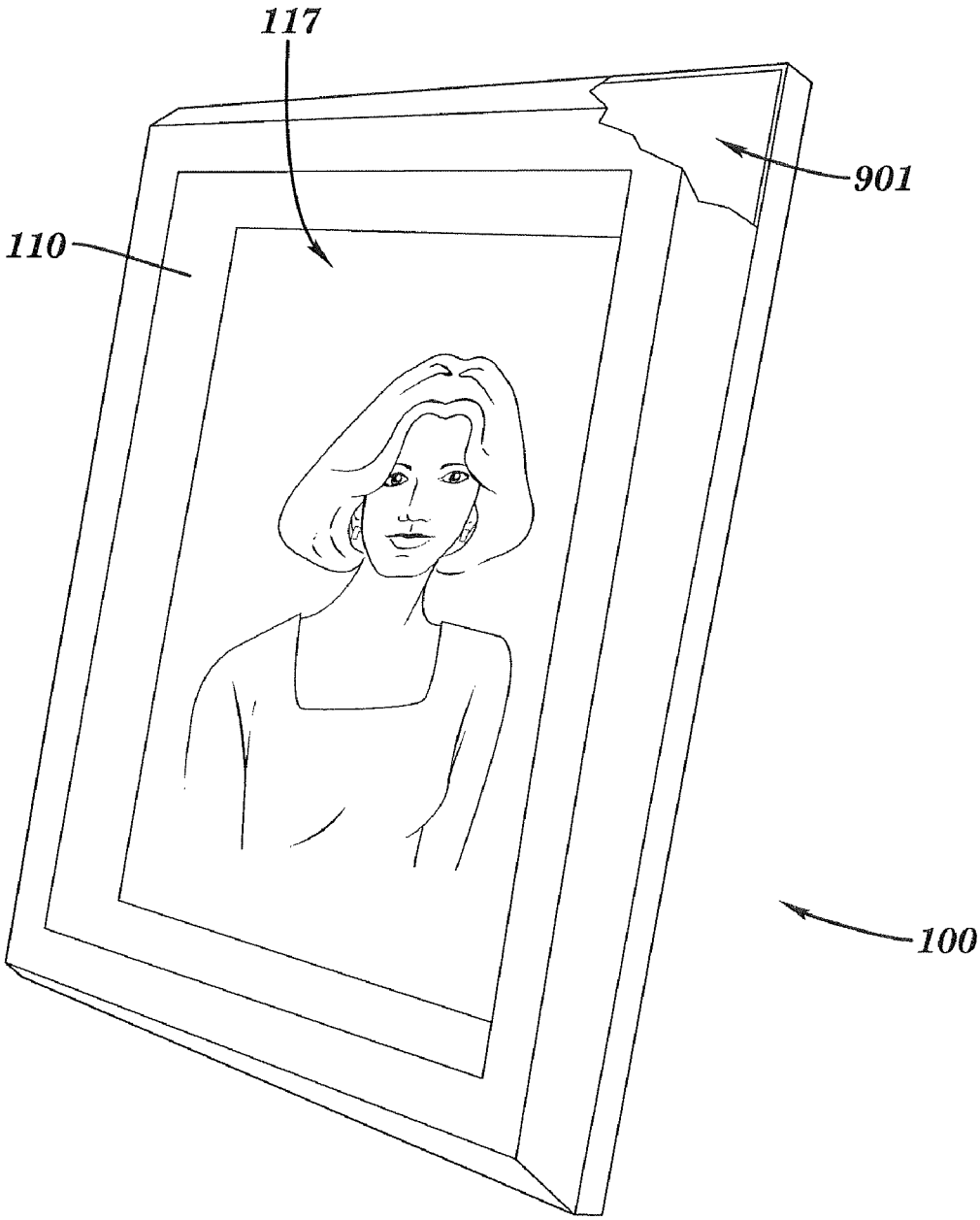
FIG. 10 is an illustration of a perspective view of the frame of FIG. 7A further comprising an inner frame, in accordance with embodiments of the present invention.

FIG. 10 is an illustration of a perspective view of the frame 100 of FIG. 7A further comprising an inner frame 110. Referring to FIG. 2, the inner frame 110 may be inserted through the front face opening 117 of the outer frame 105, where the inner frame 110 may be disposed on inwardly protruding flanges, such as those in FIG. 2 and FIG. 9. Cut-away section 901 of FIG. 10 illustrates how elastic members 800, illustrated in FIG. 7A and 7B, may be substantially covered or hidden from view by the inner frame 110, when section 901 of FIG. 10 is compared with section 805 of FIG. 7A, for example.

Figure 11A:
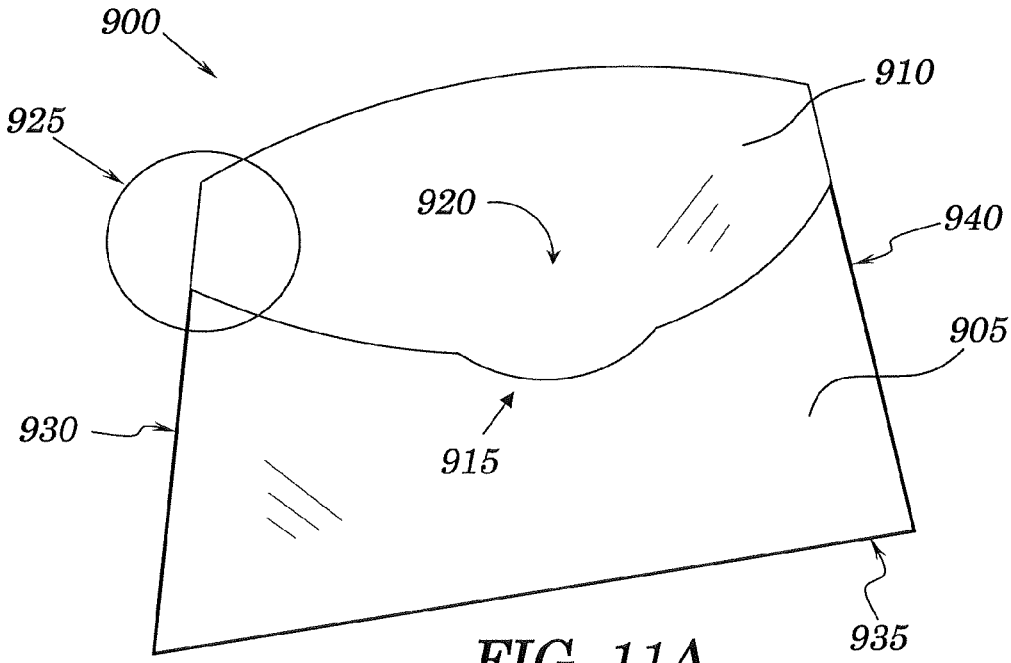
FIG. 11A is a perspective illustration of an embodiment of a pocket which may be configured to be attached to the back panel of FIG. 4, in accordance with embodiments of the present invention.

FIG. 11A is a perspective illustration of an embodiment of a pocket 900 which may be configured to be attached to the back panel 120 of FIG. 4 prior to assembly of the outer frame 105 of FIG. 1 as described above. The pocket 900 may be used to hold a photograph, picture, drawing, design, or other similar item to be displayed in the frame 100 in FIG. 1, where the photograph, for example, may be placed inside the interior 920 of the pocket 900. The pocket 900 may comprise two overlapping sheets 905 and 910 where sheets 905 and 910 may be comprised of plastic, acetate, paper, or the like. Sheets 905 and 910 may be substantially or partially transparent. Sheets 905 and 910 may have at least one portion removed or substantially transparent to allow viewing of a photograph through the sheets 905 and 910 when other portions of sheets 905 and/or 910 may be substantially opaque or translucent.

Border edge 915 of sheet 905 may have an edge shape substantially conforming to the shape of an edge of cutout 320 in FIG. 4 and FIG. 3.

Figure 11B:
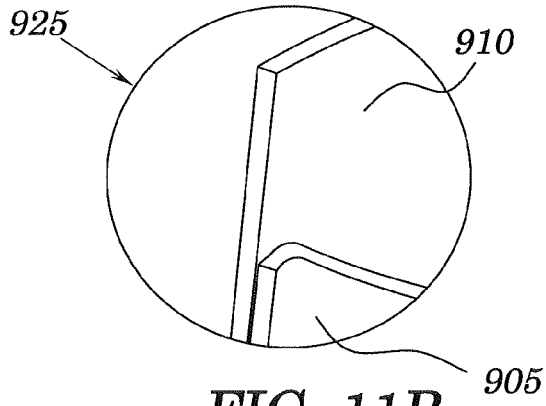
FIG. 11B is an illustration of an exploded view of section 925 of FIG. 11A, in accordance with embodiments of the present invention.

FIG. 11B is an illustration of an exploded view of a section 925 of FIG. 11A illustrating an example of an embodiment of a pocket 900, wherein sheets 905 and 910 may be joined in a partially overlapping edge configuration. The sheets 905 and 910 may be bonded together along edges 930, 935, and 940 using adhesive, thermal bonding techniques, tape, staples, combinations of these and the like to form pocket 900. Pocket 900 may be positioned flush against the back panel 120 in FIG. 4 such that pocket 900 is disposed inside the substantially hollow interior 125 of the display frame 100, between the back panel 120 and front face 107. The pocket 900 may be adhered to the back panel using adhesives, tape, staples, and the like, in such a way as to align edge 915 of FIG. 11A with the corresponding cutout edge in cutout slot 320 in FIG. 4 such that edge 915 is substantially aligned with and adjoining the cut out slot 320. Adhering methods used to adhere pocket 900 to back panel 120 may be configured such they do not interfere with other features of the back panel 120, such as easel back stand 310 and easel support brace 315 shown in FIG. 5 for example.

Figure 12A:
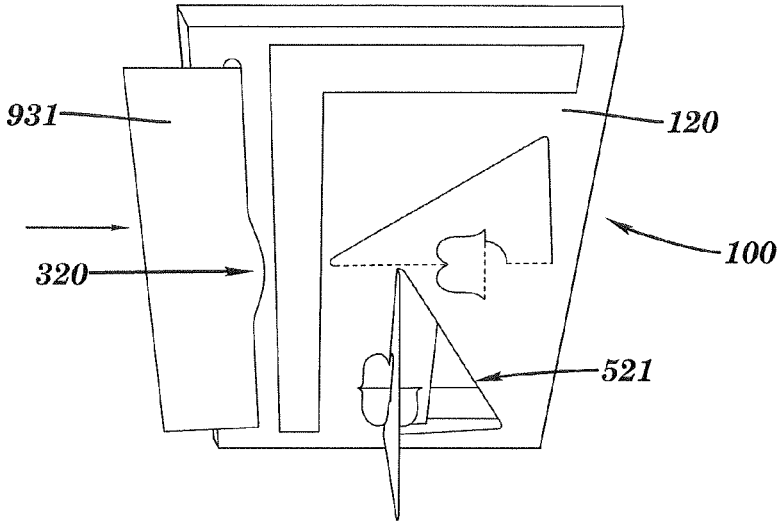
FIG. 12A is an illustration of a rear view of a display frame, in accordance with embodiments of the present invention.
Figure 12B:
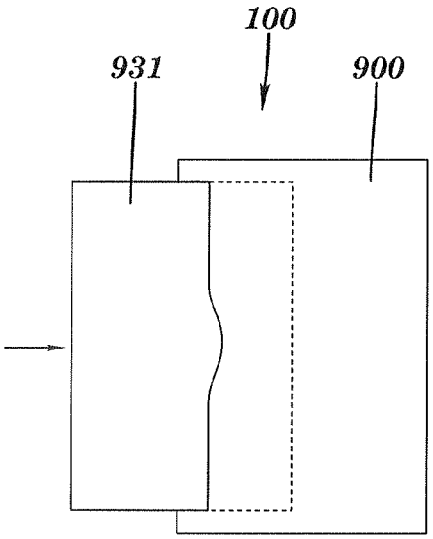
FIG. 12B is an illustration of an item 931 being inserted into a pocket 900, in accordance with embodiments of the present invention.
Figure 12C:
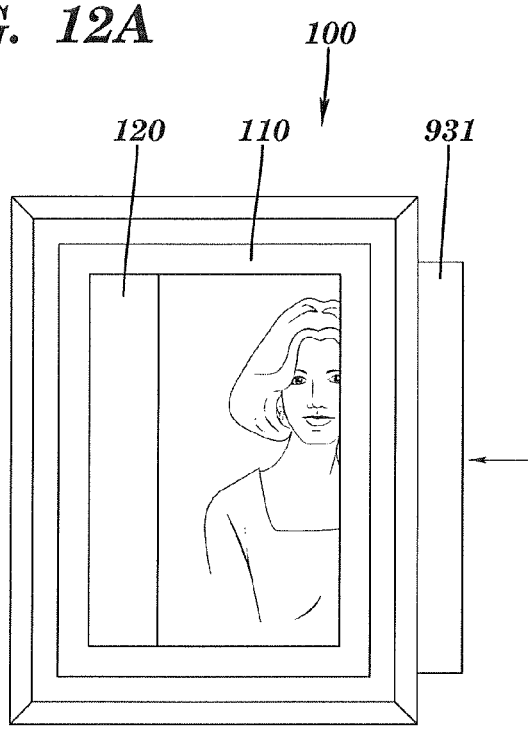
FIG. 12C is an illustration of a front view of FIG. 12A, in accordance with embodiments of the present invention.

FIGS. 12A, 12B, and 12C, are illustrations which may illustrate how an item 931 for display, such as a photograph for example, may be inserted through a cut out slot 320 and into a pocket 900 of a display frame 100. FIG. 12A is an illustration of a rear view of a display frame 100, illustrating how a display item 931 may be inserted through the slot 320 of the back panel 120. FIG. 12B is an illustration of an item 931 being inserted into a pocket 900. The pocket 900 may be disposed within the substantially hollow interior of a display frame 100 as described above. FIG. 12C is an illustration of a front view of FIG. 12A, illustrating how an item 931 for display may be inserted into the frame 100, where the item 931 may be disposed between the back panel 120 and the inner frame 110. Pocket 900 may protect an item for display 931, such as a picture or photograph, from dust accumulation and may prevent an edge of the item 931 from being caught or snagged on back panel 120 sections, such as cut lines 521 and/or 522 in FIG. 5 for example, resulting in allowing the item 931 to be easily inserted through the slot 320 and into the pocket 900. The pocket 900 may hold the item 931 in a stable position inside the pocket 900 flush against the back panel 120 while being displayed. The pocket 900 of the present invention may provide an advantage over a frame design which requires removal of a back cover to insert a display item and/or where a glass cover requires removal to insert a display item. When the item 931 is properly inserted into the pocket 900, the item 931 may be viewed through opening 115 of the display frame 100.

In another embodiment, a single substantially transparent sheet may be adhered to the back panel 120 within the substantially hollow interior 125. The transparent sheet may be configured such that the item 931 for display may be inserted into the frame through cut out slot 320. The item 931 may be disposed between the transparent sheet and the back panel 120, where the sheet may protect the inserted item 931. The transparent sheet may have one side open wherein the open side is aligned with and adjoining the slot 320. This embodiment may offer reduced complexity and reduced cost over the pocket 900 described above.

The outer frame 105 and its components, such as the front face 107, side members 210 and back panel 120, and the inner frame 110, may be configured such that designs or patterns may be printed on them either prior to or after assembly. For example, the outer frame or inner frame when constructed of paper, cardboard, or plastic, may be printed on directly, using a printing device coupled to a computer system having a compatible software program comprising, for example, image editing capabilities. For example, the printing device may comprise a laser printer, an inkjet printer, a dot matrix printer, a toner based printer, a solid ink printer, a dye sublimation printer, an inkless printer, and the like. In another example, the outer frame 105 and its components, such as the front face 107, side members 210 and back panel 120, and the inner frame 110 may be comprised of photographic paper specially configured for reproducing and printing photographs and images through a laser printer, an inkjet printer, a dye sublimation printer, an inkless printer, and the like. The ability to transfer or print designs or patterns directly onto the outer frame 105 and its components, such as the front face 107, side members 210 and back panel 120, and the inner frame 110 may provide the user with the ability to create a decorative theme associated with the displayed item, such as a photograph.

A printed design which includes subpanels 416A, 416B, 416C, 416D, 437A, 437B, 437C, and 437D may create a "wrap around" design effect which may create a desirable dimensional component to the display frame 100, for example, by providing a continuous design which may extend from the front face 107, around the side members 210, more specifically subpanels 416A, 416B, 416C, 416D, 437A, 437B, 437C, and 437D, and to the back panel 120 of the outer frame 105.

The outer frame 105 and its components, such as the front face 107, and the inner frame 110 may be configured such that tangible objects may be adhered to these components of the display frame 100, where the object may compress sufficiently flat along with the display frame 100 such that both the frame and the attached object will substantially fit inside a mailing or storage envelope. For example, the outward surface of the outer frame 105 and its components, such as the front face 107, side members 210, and the inner frame 110 may be configured to allow adhesives to be applied in order to adhere objects to the outer frame 105 and its components, such as the front face 107, side members 210, and the inner frame 110. For example, the surfaces of the outer frame 105 and its components, such as the front face 107, side members 210, and the inner frame 110 may comprise paper or other similar material that adhesives may adhere to or the surfaces may be treated with a coating that allows for the adhesion of adhesives. Configuring the outer frame 105 and its components, such as the front face 107, side members 210, and the inner frame 110 to allow adhesives to adhere may allow a user of the present invention to produce a visual theme for the displayed photograph or image. For example, a bow may be attached for a wedding themed frame, a miniature graduation cap may be attached for a graduation themed frame, or adhesive backed stickers may be attached to provide a varied appearance. Those skilled in the art will recognize there exists a multitude of adhesive backed objects and materials that may be applied to the outer frame and/or inner frame within the scope of the present invention.

The frame of the present invention may be embossed on the outer frame 105, inner frame 110, or a combination of these, where the embossment may produce a raised appearance and provide texture. Such an appearance may create a visual appearance which may not be achieved with traditional wood, metal, or ceramic frames. In addition, an embossed pattern may be reproduced on multiple frames to create matching patterns between different individual frames. For example, a preferred wood grain pattern may be embossed on the outer frame, where such a pattern may be used on a plurality of display frames producing a consistent appearance for each frame.

Figure 13:
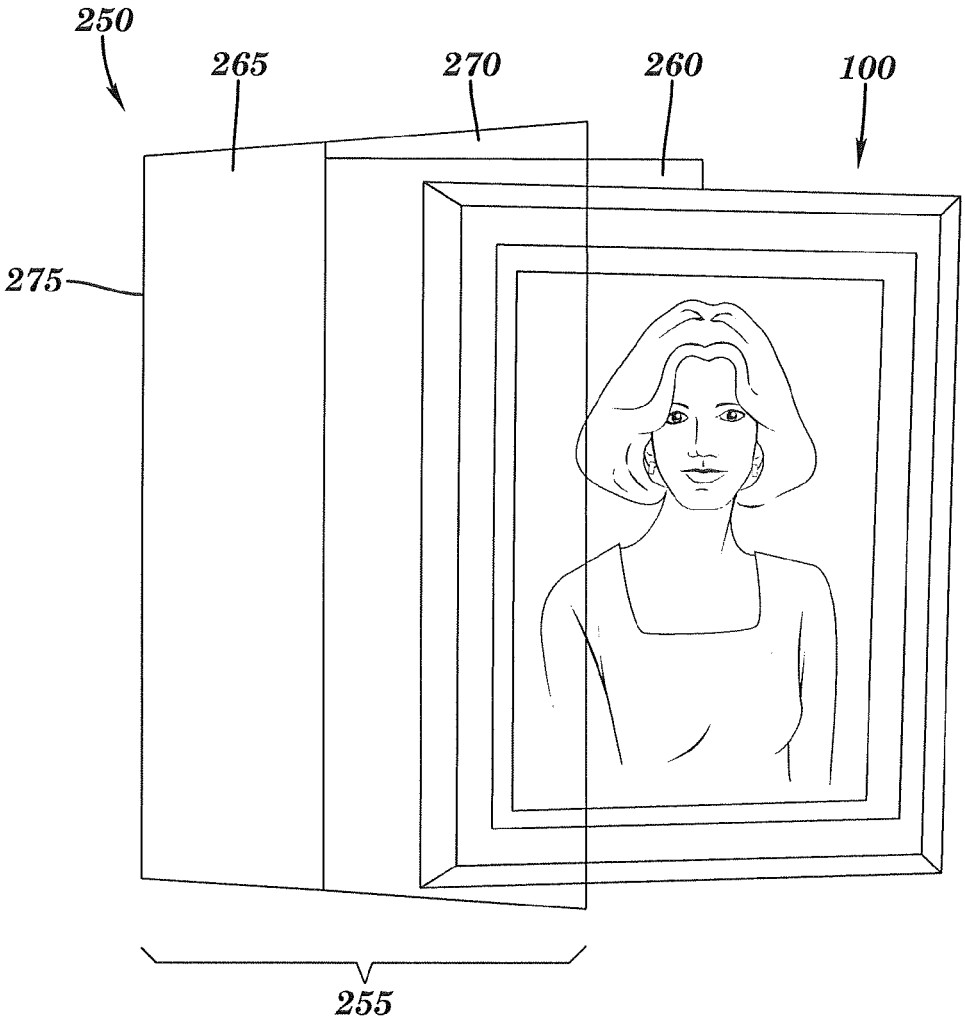
FIG. 13 is an illustration of an example of an insertion card and display frame, in accordance with embodiments of the present invention.

FIG. 13 is an illustration of an example of an insertion card 250, which may be configured to accept and substantially compress a display frame 100 such that, in combination, the display frame 100 and the card 250 may be easily inserted into an envelope for mailing and/or storage. The insertion card 250 may comprise a front cover 255 hingedly connected along a hinged edge 275 to a rear cover 260. The front cover 255, rear cover 260, or sections thereof may be substantially transparent, substantially opaque, translucent, or a combination of these. For example, the rear cover 260 of the card 250 may be opaque and the front cover 255 may be transparent. In another example, the front cover 255 may divided into an opaque section 265 and a transparent section 270. A transparent section 270 of the insertion card 250 may allow the user the ability to see the frame through the transparent section 270 as the frame automatically self-expands as it is removed from an envelope and insertion card 250. The insertion card 250 may be configured to assist insertion of the display frame 100 into a mailing envelope. The display frame 100 may be inserted into the insertion card 250, and then the insertion card 250, in combination with the display frame 100, may be inserted into an envelope hinged edge 275 first. The insertion card 250 may be forced to close as the hinged edge 275 of the insertion card 250 is slid into a mailing envelope. A compressive force may be applied to the display frame 100 (such as by a user, or by the snug fit of the envelope forcing the insertion card to close, for examples), resulting in collapsing the frame 100 inside the insertion card 250 into a substantially collapsed configuration, which may allow for the easy insertion of the insertion card 250 in combination with the display frame 100 into an envelope. The insertion card 250 may prevent edges of the frame from engaging corners of an envelope. The insertion card 250 may be comprised of paper, plastic, cardboard, cardstock, combinations of these, and the like. For example, an opaque portion 265 may be comprised of cardboard and a substantially transparent portion 270 may be comprised of acetate. In an embodiment of the present invention, the insertion card 250 may be configured for use as a greeting card to accompany an inserted display frame, where the insertion card 250 may be decorated with holiday or special occasion designs and may comprise a preprinted greeting.

In another embodiment of the present invention, the frame 100 may be secured to the rear cover 260 of the insertion card 250 using adhesive, tape, staples, hook and loop type fasteners such as VELCRO, magnets, combinations of these and the like. Securing the frame 100 to the insertion cared 250 may provide a user with single unit comprised of a combination of the frame 100 and insertion card 250 which may be displayed with a message or graphics on the front 255 or rear 260 covers of the insertion card 250.

An embodiment of the present invention comprises an adapter card which may be used to fit an item for display into a display frame of the present invention, where the item for display is too small to fit properly in the display frame. The adapter card may have a front cover hingedly connected to a back cover. The adapter card may be configured and of a proper size to be inserted into the display frame for which the display item is too small. The adapter card may have an opening in the front cover to allow viewing of the item for display when the item is inserted into the adapter card, between the front cover and the back cover. The adapter card may then be inserted into the slot in the back panel of the display frame such that the item for display may be viewed through the opening of the front cover of the adapter card. The opening in the adapter card may be configured to be large enough to view the item for display, and small enough such that the front cover of the adapter card may provide a border around the item for display and also securely hold the item for display against the back cover of the adapter card.

This display frame of the present invention may allow a user to create their own frame design, such as by using their own digital photographs at retail photo kiosks or at home using a purchased display frame kit, for example.

Figure 14:
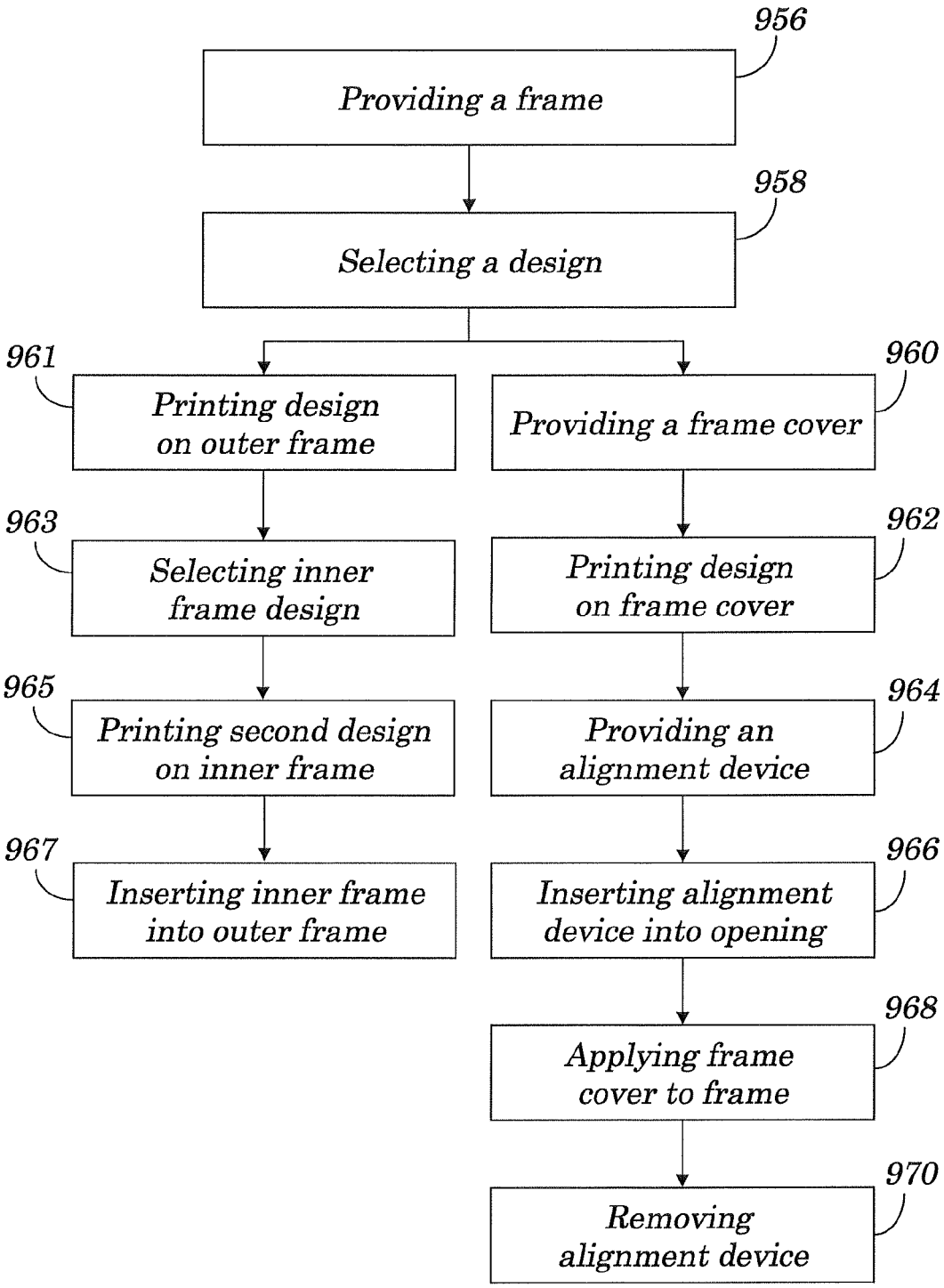
FIG. 14 is a flow chart illustrating steps for decorating a collapsible display frame, in accordance with embodiments of the present invention.

FIG. 14 is a flow chart illustrating steps for decorating a collapsible display frame as described above. Step 956 provides a collapsible, self-expanding display frame, such as that described above in embodiments of the present invention, wherein the display frame components may comprise an outer frame, an inner frame and at least one elastic member.

In step 958, a design is selected for the outer frame of the display frame provided in step 956. The design may be selected from a hard copy list presented to a user, such as from a paper sheet of selections, for example. The design may be selected through a computer interface of a computer system, where the computer system may comprise a processor, an input device coupled to the processor, an output device coupled to the processor, and memory devices coupled to the processor. The input device may be, inter alia, a keyboard, a mouse, a touch sensitive screen, etc. The output device may be, inter alia, a printer, a plotter, a computer screen, a magnetic tape, a removable hard disk, a floppy disk, a USB flash drive, etc. The memory device may be, inter alia, a hard disk, a floppy disk, a magnetic tape, an optical storage such as a compact disc (CD) or a digital video disc (DVD), a random access memory (RAM), a read-only memory (ROM), etc. The memory device may include a computer code which is a computer program that comprises computer-executable instructions for preparing a display frame. The processor may execute the computer code.

For example, the design may be stored in a computer program in a computer system memory device, wherein execution of the software on a computer system may present to a user, on an output device, a choice of selecting between predetermined designs. The user may execute a software program stored in a computer system to create the user's own design. The selection may be performed by a user at home, at a retail location, on a website, or similar location, for example. The design may be automatically printed by a computer system upon selection by a user, or may be stored in a memory device for printing or modifying by a user.

Step 960 provides at least one frame cover configured to substantially conform to at least one component of the display frame. The frame cover may be at least one piece of material which may be configured to substantially conform to a surface of at least one component of the display frame such as the inner frame, the outer frame, components of the outer frame such as the side members, the front face, or the back panel, or combinations thereof. The frame cover may be applied and/or adhered to the display frame or components thereof, where the at least one frame cover may be an inner frame cover, an outer frame cover, a cover for components of the outer frame such as a front face cover, side members, or a combination of these. The frame cover material may be paper, fabric, plastic, combinations of these, and the like, where the frame cover may comprise an adhesive applied to one surface of the frame cover to allow for adhesion onto the display frame.

Figure 15:
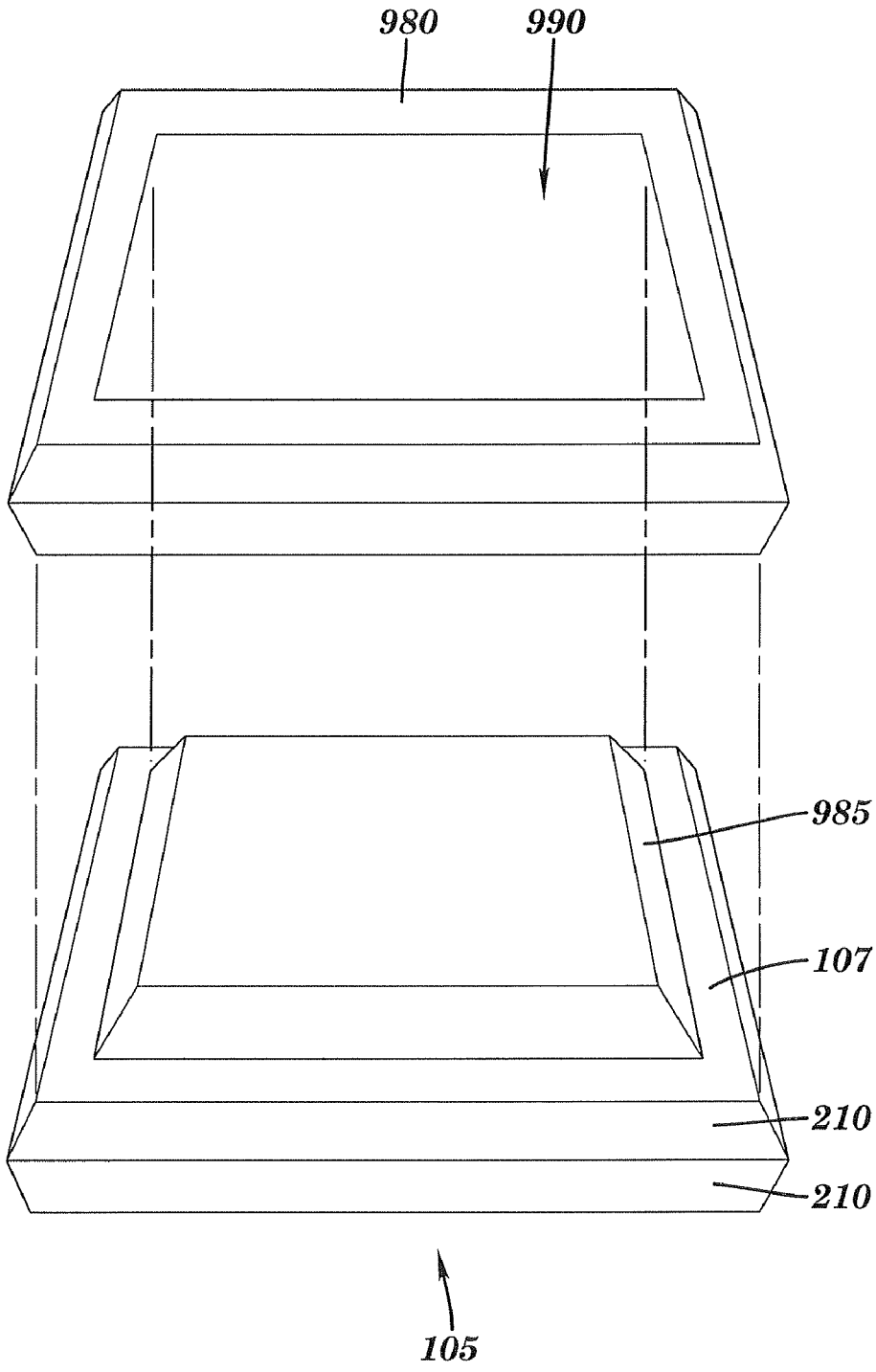
FIG. 15 is an illustration of an example of an alignment device, in accordance with embodiments of the present invention.

For example, the frame cover may comprise an outer frame cover comprising a blank printable die cut paper sheet. FIG. 15 is an illustration of an outer frame cover 980 having a frame cover opening 990, where the frame cover may be adhered to the front face 107 and side members 210 of an outer frame 105. The frame cover 980 may be adhesive-backed with a protective backing or adhesive may be applied to the frame cover 980 or to the frame 100.

In step 962, a selected design is printed on the frame cover. The printing may be accomplished using a printing device such as a laser printer, an inkjet printer, and the like. The printing device may be connected to a computer system, such as in a retail location or at a user's home, for example. The user may modify the design selected in step 960 using computer software configured to modify the data associated with the selected design.

An alignment device is provided in step 964, such as a jig, brace, bracket, clamp, and the like. The alignment device may be configured to substantially fill the opening of the outer frame, where the alignment device may snugly fit in the opening. The alignment device may protrude from the opening of the outer frame. The alignment device may be configured to assist a user with aligning the frame cover properly on the respective outer frame components, where the alignment device may be configured to prevent the frame cover from being adhered in an off-center position.

In step 966, the alignment device is inserted into the opening of the frame. FIG. 15 is an illustration of an example of an alignment device 985 which has been inserted into an outer frame 105, which may assist the alignment of a frame cover 980 with an outer frame 105 including its components front face 107 and side members 210. The alignment device 985 may protrude from the surface of the outer frame 105 and substantially fill the opening 990 of the frame cover when the frame cover 990 is placed over the front face 107 and side members 210, resulting in preventing the frame cover 980 from misaligning as it is adhered to the front face 107 and side members 210.

In step 968, the frame cover is applied to the outer frame, where the frame cover may be applied to the respective outer frame 105 components such as the front face 107 and the side members 210. For example, a die cut frame cover with its printed design may be peeled from a protective backing sheet, such as by lifting the die cut frame cover from one of its corners. The printed peeled frame cover may then be placed on the respective outer frame components, adhesive side down, using an alignment device to align the frame cover with the respective outer frame components.

After application of the frame cover, the alignment device may be removed as in step 970.

In another embodiment of the present invention, following the design selection step in step 958, at least one design may be printed directly onto the display frame or components thereof. Step 961 provides for printing the design selected in step 958, which may comprise printing directly onto the outer frame provided with the display frame in step 956 using a printing device such as a printer or the like as described above. The reversibly collapsible configuration of the display frame in embodiments of the present invention may provide for inserting the outer frame 105, in a substantially compressed state, directly into a printing device where the outer frame 105 may be fully or partially assembled. The outer frame 105 also may be inserted directly into a printing device when the frame is unassembled and in the die-cut state such as in FIG. 4.

In step 963, a second design may be selected where the second design is an inner frame design, chosen to decorate an inner frame which may be provided with the display frame of step 956. The second design may be selected in the same manner as described above for the design selected in step 958. The second design may be the same as or different from the design selected in step 958.

Step 965 provides for printing the inner frame design onto the inner frame, where the inner frame may be inserted into a printing device, such as those described above. The design may be printed directly onto the inner frame alone or as part of a pre-scored blank sheet. For example, a pre-scored sheet of suitable paper for printing images (such as photographic printing paper, laser printer paper, and the like) where the pattern of the inner frame has been pre-scored into the paper sheet, may be inserted directly into the printing device for printing the image on the pre-scored sheet. After printing, the scored area may be removed to separate the inner frame from the rest of the sheet. In step 967, the inner frame may then be inserted into an assembled outer frame through opening 117 of front face 107 as described above.

In an example of an embodiment of the above method within the scope of the present invention, a user may utilize an automated system, such as a kiosk in a retail location for example, which may allow a user to select and purchase a self-expanding, collapsible display frame, as described above, and at least one design for the display frame or components thereof. The automated system may print a design on a frame cover, a display frame, or components thereof, based on a selection by a user. The automated system may allow a user to select and purchase a mailing envelope and/or an insertion card for mailing the collapsible frame, where the automated system may automatically print a mailing and/or return address on the mailing envelope, based on input through a computer input device such as a keyboard, touch screen, or computer mouse. The automated system may be configured to take a photograph of the user for mailing with the selected frame, where the automated system may present the user with a selection of backgrounds for the photograph. Preassembled frames or unassembled frames may be stored within the automated system to be available for purchase by a user. An alignment tool may be provided for use by a user of the automated system, or may be available for purchase along with the collapsible frame.

In another example of an embodiment of the above method, a user may purchase a kit from a retail location, such as a store or online website, where the kit may comprise a display frame, a frame cover, an alignment device, a mailing envelope, an insertion card, and software on a storage device (such as on a CD, DVD, USB flash drive, diskette, etc.) containing a program which may provide design selections and printing capabilities. A user may install the program into a memory device of a computer system, execute the program, and make a selection of at least one frame cover via a predetermined list presented by the program through a display device of the computer system. The user may print the design on the frame cover using a printing device of the computer system. The user may then use the alignment device to align the frame cover while adhering the frame cover to the outer frame. The user may print selected designs directly onto the outer frame, inner frame, or combinations thereof. The kit may further comprise decorative items, such as scrapbooking decorations, stickers, and supplies, which a user may adhere to the collapsible frame.

The foregoing description of the embodiments of this invention has been presented for purposes of illustration and description. It is not intended to be exhaustive or to limit the invention to the precise form disclosed, and many modifications and variations are possible. Such modifications and variations that may be apparent to a person skilled in the art are intended to be included within the scope of this invention as defined by the accompanying claims.

What is claimed:

1. A display frame, comprising:

an outer frame having a substantially hollow interior, said outer frame including a front face having an opening, a back panel spaced from said front face, a first panel extending from a first side of at least one of said front face and said back panel and a second panel extending from a second side of at least one of said front face and said back panel, wherein said first side and said second side are perpendicular to each other, said first and second panels each having a flange that extends into the substantially hollow interior; and at least one elastic member flexibly connecting the flanges of the first and second panels such that the display frame is hingably tensioned to expand.

2. The display frame of claim 1, wherein said display frame is reversibly collapsible and self-expanding.

3. The display frame of claim 1, further comprising an inner frame having a second opening, said inner frame disposed between and spaced from said front face and said back panel.

4. The display frame of claim 3, wherein said inner frame substantially covers said at least one elastic member.

5. The display frame of claim 3, further comprising a transparent sheet disposed between said inner frame and said front face, wherein said transparent sheet is substantially flush against said inner frame.

6. The display frame of claim 3, wherein said flanges support said inner frame in a position substantially parallel to said back panel and said front face.

7. The display frame of claim 1, wherein said at least one elastic member comprises four elastic members, each of the four elastic members located at a corner of the display frame.

8. The display frame of claim 7, wherein said elastic members are connected under tension to attachment points on said outer frame.

9. The display frame of claim 1, wherein said outer frame comprises a continuous piece of material.

10. The display frame of claim 1, wherein said outer frame comprises a material selected from the group consisting of paper, plastic, cardboard, and combinations thereof.

11. The display frame of claim 1, further comprising a substantially oblong slot through said back panel.

12. The display frame of claim 11, further comprising a substantially transparent pocket having an opening and a substantially hollow interior, wherein said opening is aligned with the adjoining said slot, said pocket disposed between said back panel and said front face.

13. The display frame of claim 1, wherein said back panel further comprises at least one mounting device, wherein said mounting device is selected from the group consisting of a hole, a cut-out, an easel back stand, a magnet, a hook and loop fastener, and combinations thereof.

14. The display frame of claim 1, wherein said display frame comprises a substantially transparent sheet disposed inside said hollow interior and adhered to said back panel.

15. A display frame, comprising:

an outer frame having a substantially hollow interior, said outer frame comprising a front face having an opening, a back panel spaced from said front face and side members hingedly connecting said front face to said back panel; and an inner frame having a second opening, said inner frame disposed between and spaced from said front face and said back panel, said inner frame extending into the opening of the outer frame such that said inner frame is observable when viewing the front of the display frame, said inner frame having a length and width that is greater than a length and width of both the front face and the back panel.

16. A display frame, comprising:

an outer frame having a substantially hollow interior, said outer frame including a front face having an opening, a back panel spaced from said front face, and a plurality of side members located between said front face and said back panel; and at least four elastic members flexibly connecting at least two of said side members such that said front panel and said back panel are hingedly attached, said elastic members completely disposed within the substantially hollow interior between said front face and said back panel, wherein each of the four elastic members are located at a corner of the display frame.

17. The display frame of claim 16, wherein said display frame is reversibly collapsible and self-expanding.

18. The display frame of claim 16, further comprising an inner frame having a second opening, said inner frame disposed between and spaced from said front face and said back panel, said inner frame substantially covering said at least four elastic members.

19. The display frame of claim 16, wherein said elastic members are connected under tension to attachment points on said outer frame.

20. The display frame of claim 16, wherein said outer frame comprises a continuous piece of material.

21. The display frame of claim 16, further comprising a substantially oblong slot through said back panel and further comprising a substantially transparent pocket having an opening and a substantially hollow interior, wherein said opening is aligned with and adjoining said slot, said pocket disposed between said back panel and said front face, wherein said pocket is substantially flush against said back panel.

22. The display frame of claim 16, wherein said back panel further comprises at least one mounting device, wherein said mounting device is selected from the group consisting of a hole, a cut-out, an easel back stand, a magnet, a hook and loop fastener, and combinations thereof.

23. A display frame, comprising:

an outer frame having a substantially hollow interior, said outer frame comprising a front face having an opening, a back panel spaced from said front face and side members hingedly connecting said front face to said back panel;

a substantially oblong slot through said back panel receptive of a picture; and a substantially transparent pocket comprising a first sheet having a surface that is attached to the back panel having an edge that substantially runs along the oblong slot and such that the first sheet does not substantially extend over the oblong slot, wherein the substantially transparent pocket further includes a second sheet attached to the first sheet on the opposite surface than the surface that is attached to the back panel, the second sheet extending at least substantially over the oblong slot.

24. The display frame of claim 23, wherein said display frame is reversibly collapsible and self-expanding.

25. The display frame of claim 23, further comprising an inner frame having a second opening, said inner frame disposed between and spaced from said front face and said back panel, said inner frame substantially covering said at least one elastic member.

26. The display frame of claim 23, further comprising four elastic members, each of the four elastic members flexibly connecting at least two of said side members such that said front panel and said back panel are hingedly attached.

27. The display frame of claim 26, wherein said wherein said elastic members are connected under tension to attachment points on said outer frame.

28. The display frame of claim 23, wherein said outer frame comprises a continuous piece of material.

29. The display frame of claim 23, wherein said back panel further comprises at least one mounting device, wherein said mounting device is selected from the group consisting of a hole, a cut-out, an easel back stand, a magnet, a hook and loop fastener, and combinations thereof.

30. A display frame, comprising:

an outer frame having a substantially hollow interior, said outer frame including a front face having an opening, a back panel spaced from said front face, and a plurality of side members located between said front face and said back panel; and at least one elastic member flexibly connecting at least two of said side members such that said front panel and said back panel are hingedly attached, said elastic member completely disposed within the substantially hollow interior between said front face and said back panel; and an inner frame having a second opening, said inner frame disposed between and spaced from said front face and said back panel, said inner frame substantially covering said at least one elastic member.

* * * * *